United States Patent [19]

Harwell, Jr. et al.

[11] 4,148,482

[45] Apr. 10, 1979

[54] HOCKEY STICK REINFORCING METHOD AND PRODUCT

[75] Inventors: Roy M. Harwell, Jr.; Richard T. Hill, both of Gastonia, N.C.

[73] Assignee: Charles R. Rhodes

[21] Appl. No.: 763,102

[22] Filed: Jan. 31, 1977

[51] Int. Cl.[2] ..... A63B 59/14

[52] U.S. Cl. ..... 273/67 A; 66/170

[58] Field of Search ..... 273/67 A, 72 R, 73 F, 273/80 R, 80 B, 82 R, DIG. 7, DIG. 12, DIG. 23; 66/169 R, 169 A, 170, 172 R, 172 E, 202

[56] References Cited

U.S. PATENT DOCUMENTS

| | | | |
|---|---|---|---|
| 2,601,617 | 6/1952 | Klock | 66/169 X |
| 3,129,003 | 4/1964 | Mueller et al. | 273/72 R |
| 3,236,070 | 2/1966 | Clayton | 273/82 R X |
| 3,286,490 | 11/1966 | Martin | 66/172 R X |
| 3,353,826 | 11/1967 | Traverse | 273/67 A |
| 3,611,755 | 10/1971 | Millar | 66/202 X |

FOREIGN PATENT DOCUMENTS

| | | | |
|---|---|---|---|
| 2353843 | 10/1974 | Fed. Rep. of Germany | 273/67 A |
| 1261541 | 1/1972 | United Kingdom | 273/80 R |

*Primary Examiner*—Richard J. Apley

[57] ABSTRACT

A continuous length of textile tubing is knit on a circular knitting machine and includes a plurality of relatively long lengths of sleeve areas formed of a strong, wear resistant, reinforcing material such as fiberglass, polyester or an aromatic polyamide yarn separated by relatively narrow or shorter non-run sections formed by lock stitches or from yarn of a different material having rougher surface characteristics, or in other techniques which prevent running when cut. The sleeve areas are of a circumference such that, when the tube is stretched longitudinally prior to assembly on the hockey stick, the circumference is less than that of the hockey stick blade to which they are applied, and of such length as to effectively cover the tip, impact area, and handle/blade joint of a hockey stick. Prior to the assembly of the tube on the hockey stick the tubing is severed to proper length by cutting through the separating bands, the tip end tied, and slid onto the impact area of the hockey stick, whereupon a resinous coating is applied and allowed to dry and/or cure to provide a strong, superior blade, tip, impact area, and blade/handle joint for the hockey stick.

4 Claims, 3 Drawing Figures

HOCKEY STICK REINFORCING METHOD AND PRODUCT

BACKGROUND OF THE INVENTION

For some years it has been considered desirable to strengthen at least the impact area of ice and field hockey sticks with some type of material that will absorb the shock of a puck or ball striking thereagainst, and tend to reinforce the hockey stick to prevent or reduce such breakage or tip splintering as normally occurs. One of the first attempts to so reinforce hockey sticks is disclosed in the United States Patent to Gardner et al U.S. Pat. No. 2,912,245, in which a molded sleeve or cap is provided for strengthening purposes. Also, if desired, there can be applied around the surface thereof strips of cord or tape fabricated from nylon, fiberglass, cotton, or the like to provide a rougher striking surface.

Further, in the Canadian Patent to Veillet Pat. No. 591,454 issued Jan. 26, 1960, there is taught the idea of using fiberglass sheets bonded to the wooden surface of the impact area. Both of the aforementioned products are relatively expensive in view of the mold cost etc. and/or the fabrication cost of the fiberglass sheets. Further, there are added assembly problems at the hockey stick manufacturers brought about by assembly and bonding the sheets to the hockey stick, and subsequent extensive grinding of cured edges for a smooth surface.

A further attempt to solve the problem is disclosed in the United States Letters Patent to Traverse U.S. Pat. No. 3,353,826, in which a textile sock having an open end and a closed end is knit, applied to the impact area of the hockey stick, and coated with a synthetic resin material. While this is somewhat of an improvement, it is still necessary to knit each sock separately, utilize a toe closing operation, which, as is well known in the textile industry, is both time consuming and costly in the knitting process. Therefore, due to the cost involved in obtaining such individually knitted socks, the expense of the reinforcing coating has been somewhat prohibitive, and not well received in the industry. Further, while the embodiment of Traverse may work on straight blades, the newer curved or shaped blades may present a problem in stretching the material tight.

SUMMARY OF THE PRESENT INVENTION

In the present invention, however, there is no toe knit in the sock, and a continuous length of textile fabric is knit, suitable lengths cut from the continuous length of tubing for each stick to be coated, applied to the hockey stick with the tip end tied, stretched, and coated with a suitable resinous material. Upon drying or "curing" the excess material at the tip is sanded or cut away. Fiberglass, polyester, or an aromatic polyamide fiber known as Kevlar® manufactured by Dupont, have proven to be the most suitable materials from which the tubing should be knit, because of their high impact and tensil strength and durability. On the other hand, when such materials are cut to length, there is an extreme tendency to run before it can be secured because of the relatively smooth surface characteristics. Further in the case of Kevlar®, the material cannot be grinded or sanded.

In the present invention, however, relatively narrow non-run sections are formed by lock stitches, or with a material having rough surface characteristics such as cotton or other spun yarns intermittently knitted into the continuous length of tubing to alleviate the problem of raveling or running. Moreover, the non-run or runs resistant sections will indicate to the hockey stick manufacturer the point at which the tubing should be cut to provide the proper length. As used herein the term "hockey stick" includes the implements used by goalies as well as the other players.

It is therefore an object of the present invention to provide an improved reinforced coating for the tip, impact area, and blade/handle joint of hockey sticks.

It is another object of the present invention to provide an improved method for economically fabricating and applying a reinforcing coating to the lower end of hockey sticks.

It is a further object of the present invention to provide a hockey stick reinforcing coating which includes a textile fabric which is fabricated in a continuous tube, cut to proper length, and applied to the hockey stick without the attendant problems of running.

Other objects and a fuller understanding of the present invention will become apparent from reading the following detailed description of a preferred embodiment along with the accompanying drawings in which:

FIG. 1 is a perspective view of a hockey stick having the reinforcing product of the present invention applied thereto;

FIG. 1*a* is a perspective view of the tip end of the blade area during an intermediate stage of manufacture; and FIG. 2 is a perspective view illustrating a section of the continuous length of tubing according to the present invention.

DETAILED DESCRIPTION OF THE PREFERRED EMBODIMENT

Figure 1:
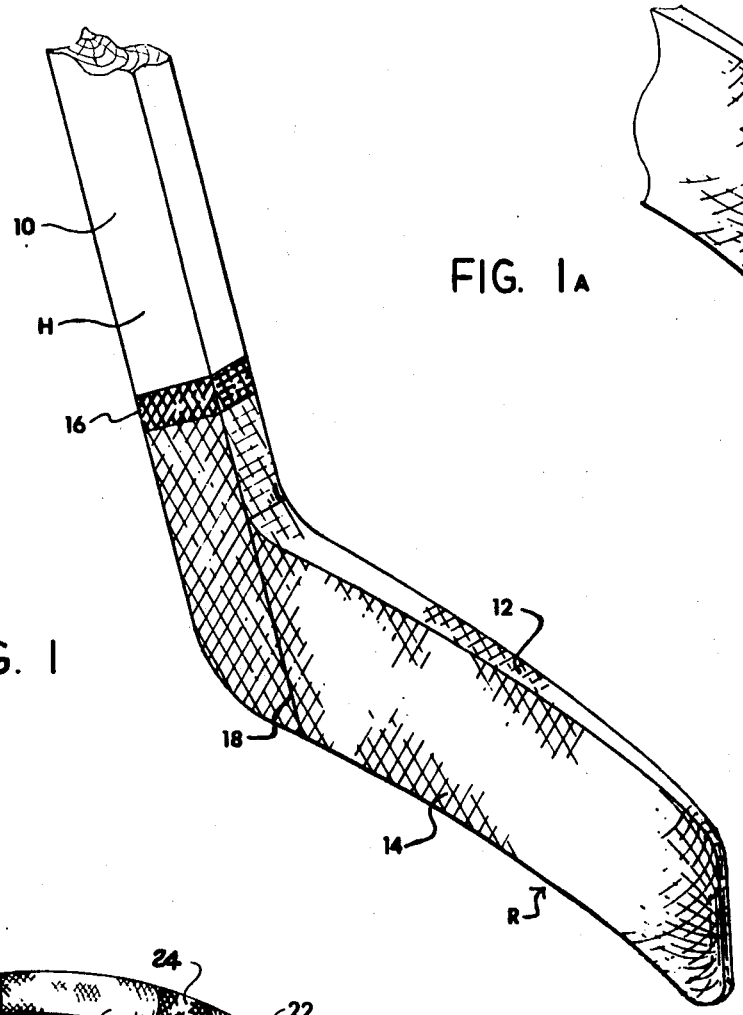

Referring now to the drawings, there is illustrated in FIG. 1 a conventional hockey stick H having a handle portion 10, a blade or impact portion 12, and a blade/handle joint 18. According to the present invention, there is provided a reinforcing or coating member R, which is formed from a continuous length of textile tubing. The tubing is preferably knit with an initial diameter such that when pulled on the hockey stick and stretched longitudinally, the circumference of the tube is stretched tautly around the corresponding circumference of the impact area of the hockey stick H to which it is to be applied. As a result the tubing fits snugly, even on the curved blades. The reinforcing or coating product R is formed from diverse materials with a relatively long sleeve area 14 being formed of a strong, reinforcing material such as fiberglass, polyester, or the Kevlar®, while the edge portion 16 is formed from a non-run or run-resistant material, such as cotton, or other spun yarns which have a relatively rough surface characteristic.

Figure 2:
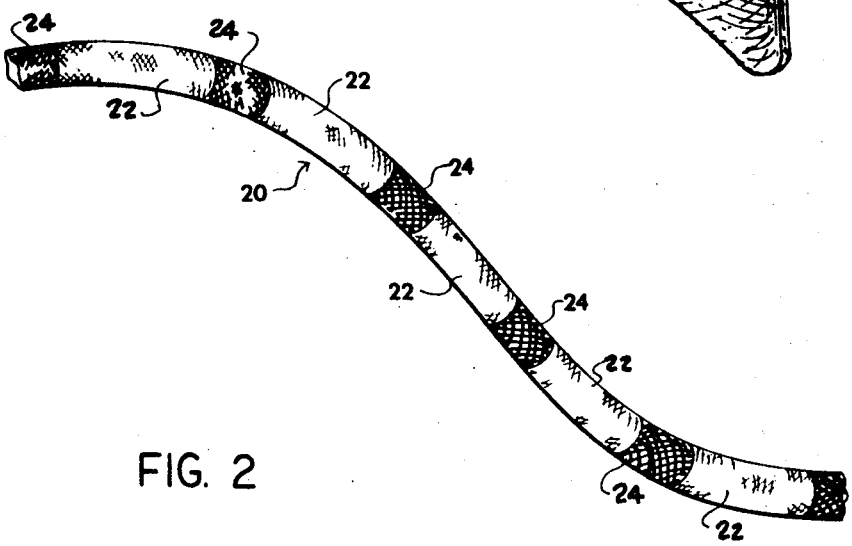

The reinforcing or coating member R is, as illustrated in FIG. 2, initially formed on a small diameter, circular knitting machine in a continuously knitted length of textile tubing 20 having a plurality of relatively long areas 22 which will, when later cut to length, become the reinforcing sleeve areas 14. The diameter of the machine is so selected, that the resulting tubing will have, when stretched, a circumference less than the circumference of the portion of the stick to which it is applied. This insures a good tight fit of the tubing when pulled over the blade, even where the blade is curved, where sometimes a looser tubing would "bridge across" the curved portion.

Relatively narrow bands or webs 24 separate each of the long areas 22, and provide a dual purpose. First of all, the bands 24 are knit from a material having run-resistant qualities, as for example yarns having a relatively rough surface characteristic, such as spun yarns (e.g. cotton, to prevent running when the reinforcing coatings are cut to length from the continuous tubing 20. Other possibilities include lock stitches in bands 24 or a polypropylene that is heat set after knitting. Further, the bands 24 indicate to the hockey stick manufacturer where the tubing should be cut to length, so as to easily form lengths of consistent dimension. As aforementioned, the areas 22 are knit from either fiberglass, polyester or Kevlar ®, which are materials of relatively smooth surface characteristics. Such materials have the undesirable characteristic that they will run if the separating cut is made through fabric knit therefrom.

The Kevlar ® material while being very strong cannot be ground. Therefore, when Kevlar ® is used, subsequent to the application of the resinous coating, the tip end is severed close to the blade tip, and the non-run section of diverse material only on the lower handle portion is trimmed and sanded.

In practice, the tubing 20 is knit on a circular knitting machine in relatively long, easily shippable rolls or coils. They are then cut to length. One end is constricted and tied, then the sleeve is pulled onto the hockey stick in the manner shown in FIG. 1*a*. A resinous coating is then applied, which when hardened, cured or dry will provide a strong, durable reinforcement. The coating is not only satisfactory, but when applied according to the present invention, will be more economical than any known heretofore.

Figure 1A:
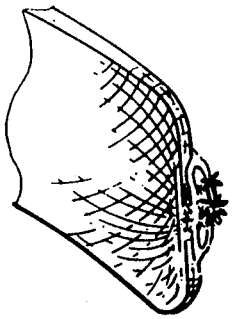

The constricted portion illustrated in FIG. 1*a* is then sanded or ground away to remove the frayed ends and form the smooth coated radius illustrated in FIG. 1. Care should be taken not to disrupt the fibers following the contoured tip. One note, the constriction should be formed around the long sleeve area 22 rather than in the webs 24, so that upon completion of the tip, none of the more unsightly non-run yarn will be visible. At the other end the edge portion 16 may remain or may be sanded or cut away.

While fiberglass, polyester, and Kevlar ® have been taught as a yarn which can be knit, and when applied provides a strong, durable coating, it is apparent that other similar materials might also be used without departing from the scope of the present invention. Other modifications and changes might be made without departing from the scope of the invention which is to be determined from the following claims.

What is claimed is:

1. A method for fabricating a reinforcing coating for the impact surfaces of hockey sticks comprising the steps of:

a. continuously knitting a length of textile tubing having a circumference, when stretched longitudinally, less than the circumference of the corresponding portion of the hockey stick;

b. in the knitted length of textile tubing according to (a), knitting relatively long lengths of sleeve areas from a material selected from a group containing fiberglass, polyester, and Kevlar ®, separated by relatively narrow bands of a run resistant material;

c. cutting said continuous lengths of textile tubing to proper lengths for use on a hockey stick by severing said continuous length through each of said bands;

d. assembling the resulting length of tubing over the tip, impact area, and blade/handle joint of a hockey stick; and e. applying a resinous coating to the tubing and grinding off excess material.

2. A continuous knitted length of textile tubing for use, when cut into lengths, as the coating for the tip, impact surface, and blade/handle joint of a hockey stick, said textile tubing comprising:

a. a plurality of spaced, relatively long sleeve areas formed from a yarn exhibiting strong durable, reinforcing characteristics, with a relatively smooth surface, said sleeve areas of such diameter as to be greater in diameter than the periphery of a hockey stick blade in a relaxed stage, but less in diameter when stretched longitudinally;

b. relatively short bands separating said long sleeve areas and formed of a yarn having relatively rough surface characteristics constructed in lock stitches.

3. In combination with a hockey stick having a tip, impact surface and blade/handle joint, a reinforced coating comprising a continuously knitted length of textile tubing which, when stretched, has a circumference less than the circumference of the impact area of the hockey stick to which the coatings are to be applied, said tubing further including a relatively long sleeve area bounded on either end by a shorter band, said sleeve area being knit from a strong, durable, reinforcing yarn selected from the group containing fiberglass, polyester, and Kevlar ®, said sleeve area being of such length as will effectively cover the tip, impact surface and blade/handle joint of a hockey stick, and said shorter bands being knit from a material having relatively rough surface characteristics, and wherein said coating material having rough surface characteristics is a spun yarn.

4. In combination with a hockey stick having a tip, impact surface and blade/handle joint, a reinforced coating comprising a continuously knitted length of textile tubing which, when stretched, has a circumference less than the circumference of the impact area of the hockey stick to which the coatings are to be applied, said tubing further including a relatively long sleeve area bounded on either end by a shorter band, said sleeve area being knit from a strong, durable, reinforcing yarn selected from the group containing fiberglass, polyester, and Kevlar ®, said sleeve area being of such length as will effectively cover the tip, impact surface and blade/handle joint of a hockey stick, and said shorter bands being knit from a material having relatively rough surface characteristics, and further including said bands being formed of a polypropylene and heat set to prevent runs.

* * * * *

UNITED STATES PATENT AND TRADEMARK OFFICE

CERTIFICATE OF CORRECTION

PATENT NO. : 4,148,482

DATED : April 10, 1979

INVENTOR(S) : Roy M. Harwell, Jr. et al.

It is certified that error appears in the above—identified patent and that said Letters Patent is hereby corrected as shown below:

On the title page delete"(73) Assignee: Charles R. Rhodes".

Signed and Sealed this

Ninth Day of December 1980

[SEAL]

*Attest:*

SIDNEY A. DIAMOND

*Attesting Officer*

*Commissioner of Patents and Trademarks*